US007421748B1

(12) United States Patent
Edgerton

(10) Patent No.: US 7,421,748 B1
(45) Date of Patent: Sep. 9, 2008

(54) SUPPORT FRAME WITH ARTICULATING STRUCTURES

(75) Inventor: John Edgerton, Omro, WI (US)

(73) Assignee: Graham-Field Health Products, Inc., Atlanta, GA (US)

( * ) Notice: Subject to any disclaimer, the term of this patent is extended or adjusted under 35 U.S.C. 154(b) by 310 days.

(21) Appl. No.: 11/173,491

(22) Filed: Jun. 30, 2005

Related U.S. Application Data

(63) Continuation of application No. 60/585,424, filed on Jul. 2, 2004.

(51) Int. Cl.
*A61G 7/012* (2006.01)

(52) U.S. Cl. ..... 5/611; 5/616

(58) Field of Classification Search ..... 5/611, 5/616, 610, 11; 296/20
See application file for complete search history.

(56) References Cited

U.S. PATENT DOCUMENTS 4,062,075 A * 12/1977 Stern et al. ..... 5/611
5,303,437 A * 4/1994 Hung ..... 5/613
6,405,393 B2 6/2002 Megown

* cited by examiner

*Primary Examiner*—Patricia Engle
*Assistant Examiner*—William Kelleher
(74) *Attorney, Agent, or Firm*—Brannen Law Office, LLC

(57) ABSTRACT

The present invention has a frame, two articulating structures, a drag link and a linear drive assembly. Each articulating structure has a rigid support, a serpentine support and a caster support. The rigid supports are pivotally connected to the frame and to the caster supports. The serpentine supports are pivotally connected to the frame, the rigid support and the caster support. The drag link makes the first and second articulating structures cooperate. The linear drive assembly is connected to the rigid support of one articulating structure and to the drag link. The linear drive assembly causes the bed to rise by acting in two directions, one to directly push the drag link in a first direction and the second to redirect the linear drive assembly force to indirectly push the drag link in the first direction by rotating the first rigid structure away from the frame.

18 Claims, 10 Drawing Sheets

SUPPORT FRAME WITH ARTICULATING STRUCTURES

This application claims priority on US Provisional Application having application No. 60/585,424, filed on Jul. 2, 2004, the entire disclosure of which is hereby incorporated herein by reference.

BACKGROUND OF THE INVENTION

1. Field of the Invention

The present invention relates to a support frame, and more particularly to a vertically adjustable support frame that is selectably raised and lowered by extending and retracting at least one articulating structure.

2. Description of the Related Art

Typically, height and angle adjustable beds are used by medical institutions, such as hospitals and nursing homes. The beds usually include a bed frame and an articulating mechanism for lowering the bed frame to a low position and raising the bed frame to a high position so that it may be used as a gurney or at any height in between. As a result, a patient can be transferred by merely sliding the patient from one gurney to another or a chair.

It is known to have height and angle adjustable beds that may be lowered to a fully lowered position near the floor; however, such beds usually require a mechanical or hydraulic compression assist mechanism or high-power hydraulic lift mechanisms to lift the bed from the fully lowered position. For example, U.S. Pat. No. 6,405,393 ("the '393 patent") incorporated by reference herein, discloses a spring assist mechanism that allows a height adjustable bed to raise from a fully lowered position. The '393 patent describes the increase in force necessary to raise the bed from the fully lowered position. This is because as the angle between the linear actuator and the bed frame in the bed shown in the '393 patent approaches zero, the cosine of that angle also approaches zero. As the cosine of the angle approaches zero, the resultant lift component, or vertical component, of the actuator force also approaches zero. The actuator is therefore at a mechanical disadvantage when the cosine of the angle approaches zero. One way to overcome such a limitation is to use multiple actuators, or an actuator having a relatively large force. Such an approach can be undesirably expensive.

Further, a mechanical or hydraulic compressive assist mechanism may be used to overcome the mechanical disadvantage. However, such components may fail unexpectedly. In addition, when such mechanisms fail, time delay, damage or injury may occur. Thus, it would be desirable to eliminate any need for mechanical and hydraulic compressive assist mechanisms.

Presently, to achieve a low bed position, one must also accept a mechanical disadvantage. Further, elimination of the mechanical disadvantage requires that the cosine of the angle between the actuator and bed frame not approach zero, and accordingly that the bed not be lowered to the desired position. Thus it would be desirable to achieve a low bed position while simultaneously avoiding a situation where the cosine of the angle between the bed frame and linear actuator approaches zero.

A still further disadvantage yet of some existing angle adjustable beds that have two motors is that the motors can get out of synchronization. In this regard, either motor may raise or lower a respective end of the bed at a different rate. This could jeopardize the health and safety of any person on the bed. Further, such a drawback could make transport during raising and lowering of the bed impractical and hazardous.

A still further disadvantage yet of existing angle adjustable beds is that they may require an undesirably large amount of swing to reposition the bed from the lowered position to the raised position. The swing occurs as a result of the support frame of the bed moving forward or rearward relative to the wheels. A large swing is disadvantageous for several reasons. First, having bed frame move forward or rearward relative to the wheels changes the center of gravity of the bed. The larger the swing, the larger the change in the center of gravity of the bed. Second, with the ever increasing pressure to reduce room size and to fit more items into existing rooms, there is a sizable disadvantage to a bed that requires a relatively large amount of swing to raise to the raised position.

A still further drawback yet is that some beds require three or more casters at each end of the bed to provide a stable structure. This leads to an undesirable number of components. Alternatively, some beds have a stabilizing rod extending between the casters from the front to the rear of the bed. These stabilizing rods can interfere with and limit the use of items such as over bed tables, patient lifts and the like.

Thus there exists a need for a support frame that solves these and other problems.

SUMMARY OF THE INVENTION

One embodiment of the present invention has a frame, two articulating structures, a drag link and a linear drive assembly. Several brackets can extend down from the frame. Each articulating structure can have a rigid support with two arms connected with a tube, and can have a serpentine support with three members. A caster support can be at the bottom of each articulating structure for supporting a pair of casters. The rigid supports are pivotally connected to the frame and to the caster supports. The serpentine supports are pivotally connected to the frame, the rigid support and the caster support. A drag link can be present for making the first and second articulating structures act in cooperation. The linear drive assembly can be connected to the rigid support of one articulating structure and to the drag link. Action of the linear drive assembly causes the bed to raise from a low position to a high position. This is accomplished by the linear drive assembly acting in two directions, one to directly push the drag link in a first direction and the second to indirectly push the drag link in the first direction by rotating the first rigid structure away from the frame.

According to one advantage of the present invention, the articulating structures collapse to a compact orientation when the bed is lowered to a low position. Yet, the longitudinal axis of the actuator of the linear drive assembly is maintained at an angle relative to the plane of the frame that is substantially greater than zero. Because this angle does not approach zero, the cosine of this angle also does not approach zero. Accordingly, the vertical lift component of the actuator force never approaches zero, even when the bed is at the fully lowered position.

According to another advantage of the present invention, the geometry of the rigid support provides a mechanical advantage to the linear drive assembly. This is advantageously accomplished by having both ends of the linear drive assembly move in opposite directions relative to the frame during operation. The first end of the linear drive assembly applies a force to push the drag link from the first articulating structure towards the second articulating structure. The second end of the linear drive assembly applies force to the rigid member of the first articulating structure to cause the second end of the first articulating structure to rotate away from the frame. This rotation causes the first end of the rigid member of the articulating structure to apply a redirected force against the drag link to also force the drag link towards the second articulating structure.

Due to the described mechanical advantage achieved, there is no need for mechanical or hydraulic compressive assist mechanisms. Advantageously, elimination of the mechanical and hydraulic compressive assist mechanisms eliminates a potential for undesirable consequences that may occur as a result of the failure of the assist mechanisms.

Related, a single linear drive assembly can be used to raise the bed from a lowered position to a raised position. Using a single linear drive assembly and a drag link to simultaneously raise and lower two articulating structures eliminates the risk that two sides of the bed could move at different rates.

A still further advantage of the present invention is that the bed is raised from a low position to a high position with a relatively low amount of swing, or movement of the frame relative to the casters. Accordingly, the center of gravity of the bed is maintained at an acceptable point during the entire movement of the bed. Further, less space is required for operation of the bed.

A still further advantage yet of the present invention is that only two casters are needed at each end of the bed. This is accomplished by use of a serpentine support in each articulating structure. The serpentine supports, combined with the rigid support, the frame and the caster supports comprise a structure resembling a split parallelogram. In this regard, the casters can be oriented at a selected orientation with respect to the ground and the frame can be oriented parallel to the ground throughout the entire range of motion of the bed.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
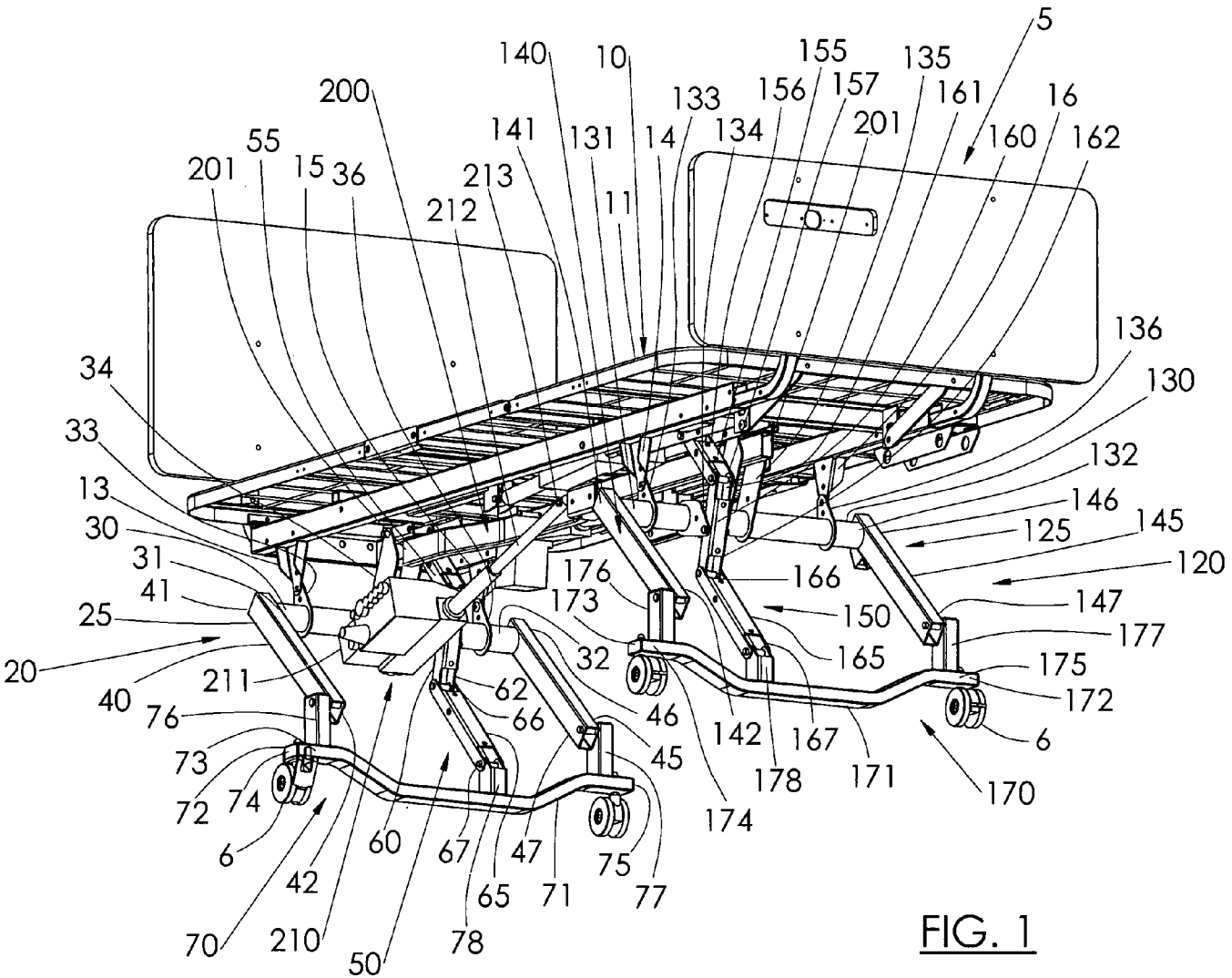
FIG. 1 is a perspective view of a preferred embodiment of the present invention in a raised position.

While the invention will be described in connection with referred embodiments, it will be understood that it is not intended to limit the invention to those embodiments. On the contrary, it is intended to cover all alternatives, modifications and equivalents as may be included within the spirit and scope of the invention as defined by the appended claims.

The preferred embodiments of the present invention are shown and described in relation with a bed 5 having four casters 6. The casters 6 of the bed 5 preferably rest on a floor 1 lying in a plane 2. In a preferred embodiment, the bed 5 has a frame 10, a first articulating structure 20, a second articulating structure 120, a drag link 200 and a linear drive assembly 210. The bed frame 10 is understood to include deck assemblies and the like, however, for the sake of clarity, the frame 10 will be described as a single structure. Of course, the principles of the present invention are applicable to beds having frames with different structures, and the scope of the present invention is not limited to the structure of the illustrated frame.

Figure 2:
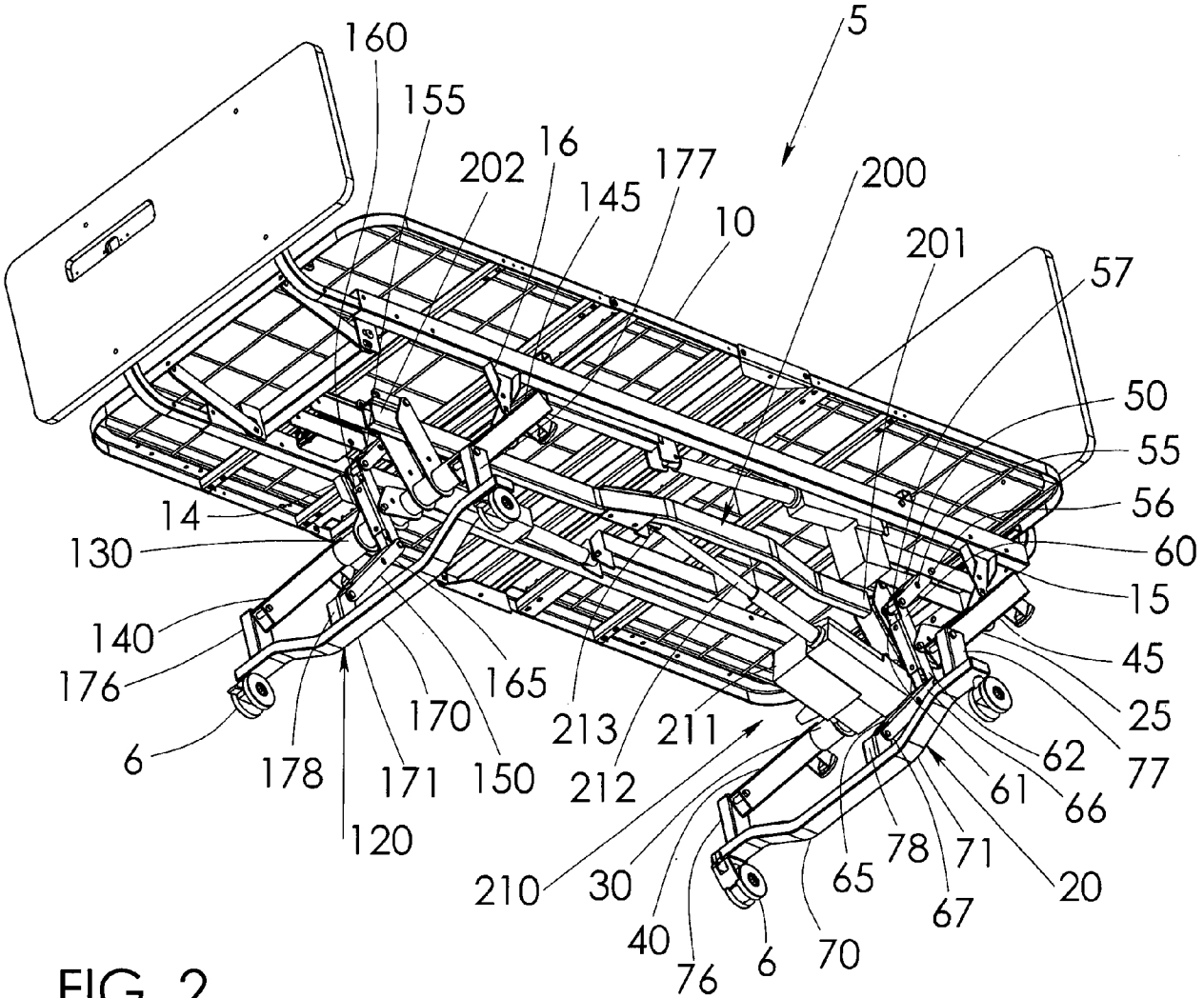
FIG. 2 is an alternative perspective view of a preferred embodiment of the present invention in a raised position.
Figure 4:
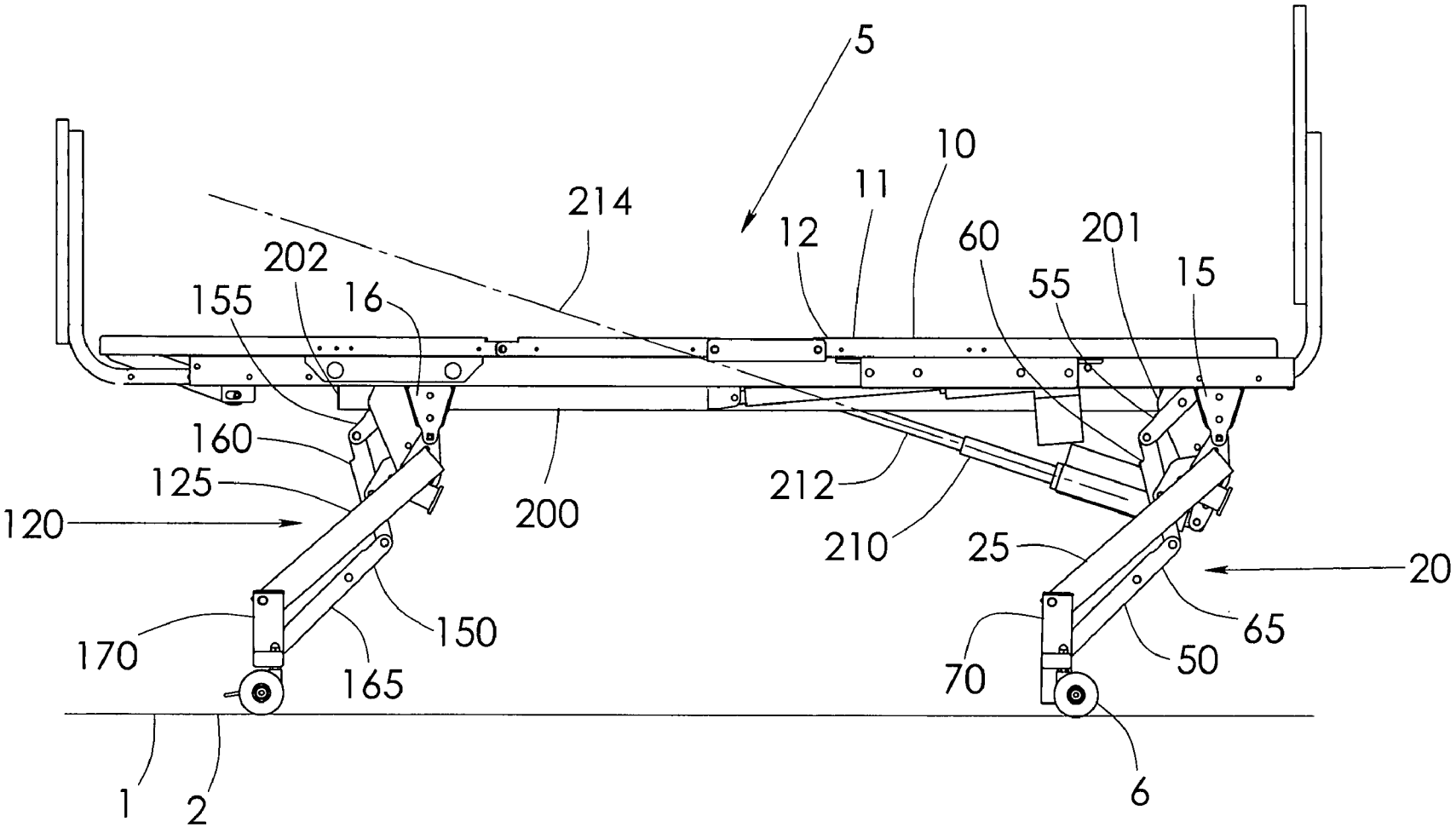
FIG. 4 is a side view of a preferred embodiment shown in a raised position.

The frame 10 has a top surface 11 lying in a plane 12, as is shown in FIG. 4. It is preferably that the top surface plane 12 be parallel to the floor 1 having a plane 2. However, any desired orientation of the top surface plane 12 can be achieved. Turning now to FIGS. 1 and 2, it is seen that four brackets 13, 14, 15, and 16, respectively depend from the frame 10 for connection with other components of the bed 5, as later described herein.

A first articulating structure 20 is provided. The first articulating structure is preferably comprised of a rigid support 25, a serpentine support 50 and a caster support 70. The components are generally and preferably shown to be hollow components having varying shapes and sizes. However, other structures, such as solid members could alternatively be used without departing from the broad aspects of the present invention.

The rigid support 25 of the first articulating structure 20 preferably comprises a tube 30. The tube 30 has a longitudinal axis that preferably lies generally parallel to the top surface plane 12. The tube 30 has a first end 31 and an opposed second end 32. Four brackets 33, 34, 35 and 36, respectively, are preferably welded or otherwise rigidly connected to the tube 30. Bracket 33 is preferably pivotally connected to bracket 13 of the frame 10. Bracket 36 is preferably pivotally connected to bracket 15 of the frame 10.

A first arm 40 is provided and has a first end 41 and a second end 42. The first end 41 is preferably rigidly connected to the first end 31 of tube 30. A second arm 45 is also provided, and has a first end 46 and a second end 47. The first arm 40 and second arm 45 are preferably connected to the tube 30 at a right angles, and as such, are parallel to each other. The tube 30, first arm 45 and second arm 50 preferably form a generally U shaped structure.

It is understood that the first rigid support 25 has many ends, including the pivot points at the second ends 42 and 47 of respective arms 40 and 45, as well as the pivot points at the ends of the brackets 33, 34, 35 and 35 rigidly connected to the tube 30.

The first articulating structure 20 also preferably comprises a serpentine support 50. In a preferred embodiment, the serpentine structure 50 comprises three members, or pieces. The first piece 55 has a first end 56 and a second end 57. The second piece 60 has a first end 61 and a second end 62. The third piece 65 has a first end 66 and a second end 67. The first end 56 of the first piece 55 is preferably pivotally connected to the frame 10. The second end 57 of the first piece 55 is preferably pivotally connected to the first end 61 of the second piece 60. The second piece 60, at a location intermediate the first end 61 and the second end 62, is preferably pivotally connected to bracket 35 on the tube 30. The second end 62 of the second piece 60 is preferably pivotally connected to the first end 66 of the third piece 65.

Further, the first articulating structure 20 also preferably comprises a caster support 70. The caster support 70 preferably comprises a base 71 having a front 72, a rear 73, a first end 74 and a second end 75. The base 71 can be a bent base, such that it dips between the ends 74 and 75, as shown in FIGS. 1 and 2. A first upright 76 is at the first end 74 of the base 71. A second upright 77 is at the second end 75 of the base 71. A third upright 78 can be connected to the base 71 intermediate the first and second ends 74 and 75. The second end 42 of the first arm 40 is preferably pivotally connected to the first upright 76. The second end 47 of the second arm 45 is preferably pivotally connected to the second upright 77. The second end 67 of the third piece 65 of the serpentine support 50 is preferably pivotally connected to the third upright 78.

Starting at a low position, the first articulating support 20 rises as the second end of the first rigid support, or the second ends 42 and 47 of the arms 40 and 45, respectively rotate away from the frame 10. The pivot point for this rotation is at the pivoting connections between the brackets 13 and 15 of the frame and 33 and 36 of the tube 30, respectively. Rotation of the tube 30 caused by the pivoting of the first rigid support causes the serpentine support 50 to straighten, and accordingly elongate. Elongation of the serpentine support 50 and rotation of the rigid structure cause the frame 10 to rise relative to the castor support 70.

Figure 12:
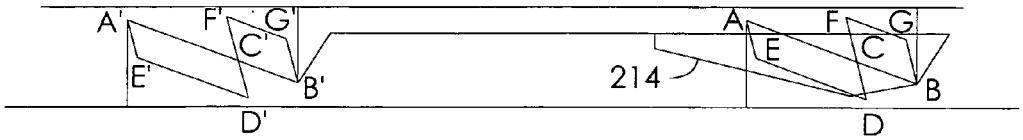
FIG. 12 is a profile of the articulating structures of the present invention illustrated functionally as lines and nodes shown in a lowered position.
Figure 11:
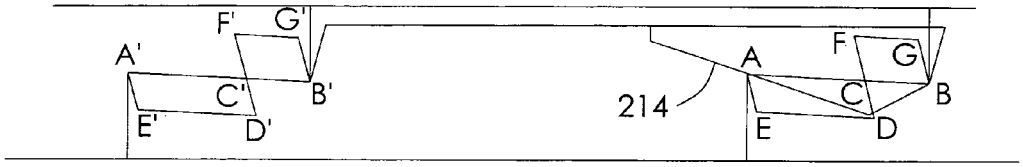
FIG. 11 is a profile of the articulating structures of the present invention illustrated functionally as lines and nodes shown in an intermediate position.
Figure 10:
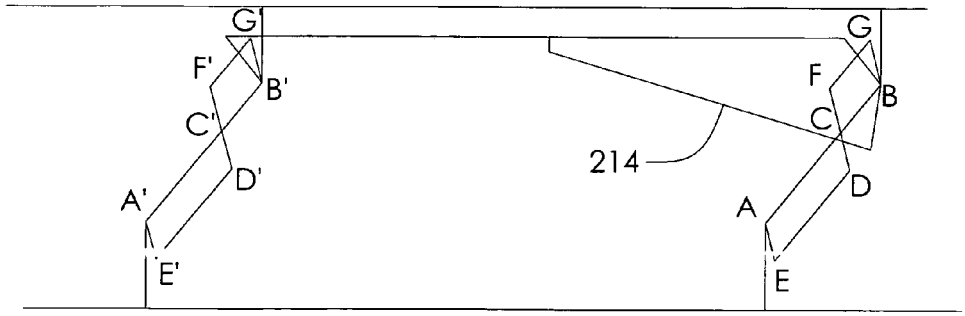
FIG. 10 is a profile of the articulating structures of the present invention illustrated functionally as lines and nodes shown in a raised position.

Looking now to FIGS. 10-12, it is shown that in profile, the first articulating structure 20 resembles a split parallelogram. In FIG. 10, point A represents the pivot point between the second end 42 of the first arm 40 and the upright 76. Point B represents the pivot point between the bracket 13 of the frame 10 and bracket 33 of the tube 30. Point C represents the longitudinal axis of the tube 30. Point D represents the pivot point between the first end 66 of the second piece 65 of the serpentine support 50 and the second end 57 of the second piece 55 of the serpentine support 50. Point E represents the pivot point between the second end 67 of the third piece 65 of the serpentine support 50 and the third upright 78 of the base. Point F represents pivot point between the first end 61 of the second piece 60 of the serpentine support 50 and the second end 57 of the first piece 55 of the serpentine support 50. Point G represents the pivot point between the first end 56 of the first piece 55 of the serpentine support 50 at the connection to the frame 10.

Line segments between points are rigid members, although not necessarily along central axis of the respective members. In this regard, line segment AB corresponds to the rigid support 25, line segment AE corresponds to the caster support 70, line segment DE corresponds to the third piece 65 of the serpentine support 50, line segment DF corresponds to the second piece 60 of the serpentine support 50, line segment FG corresponds to the first piece 55 of the serpentine support 50, and line segment GB corresponds to the frame 10. The split or double parallelogram structure allows the caster support 70, and hence the casters 6, to be in a selected orientation relative to the frame 10 no matter whether the frame 10 is in a high position, a low position, or at any position there between. A preferred orientation of the casters 6 is normal to the floor plane 2. However, it will be understood that other orientations of the casters 6 may be used without departing from the broad aspects of the present invention.

Figure 3:
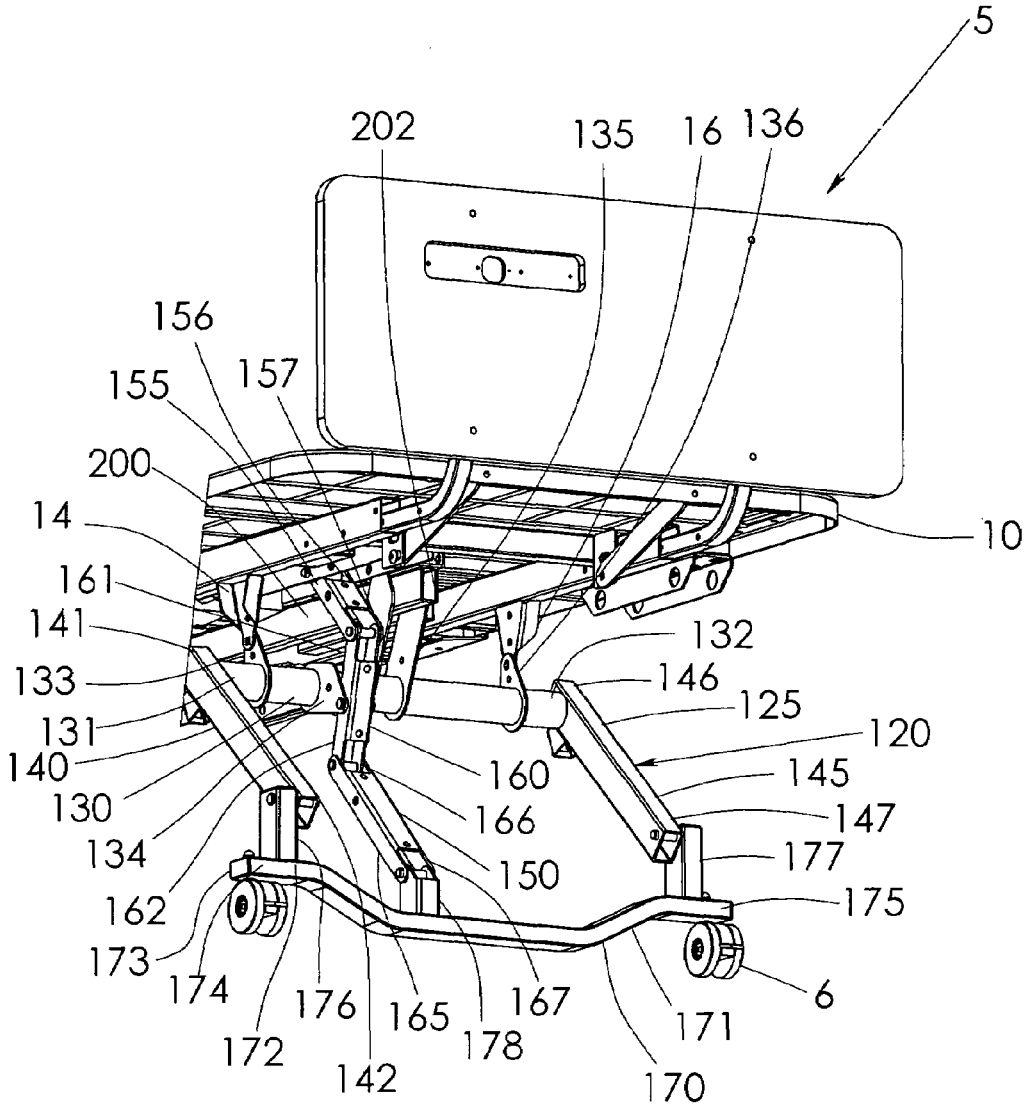
FIG. 3 is a close-up perspective view of a preferred embodiment shown in a raised position.
Figure 5:
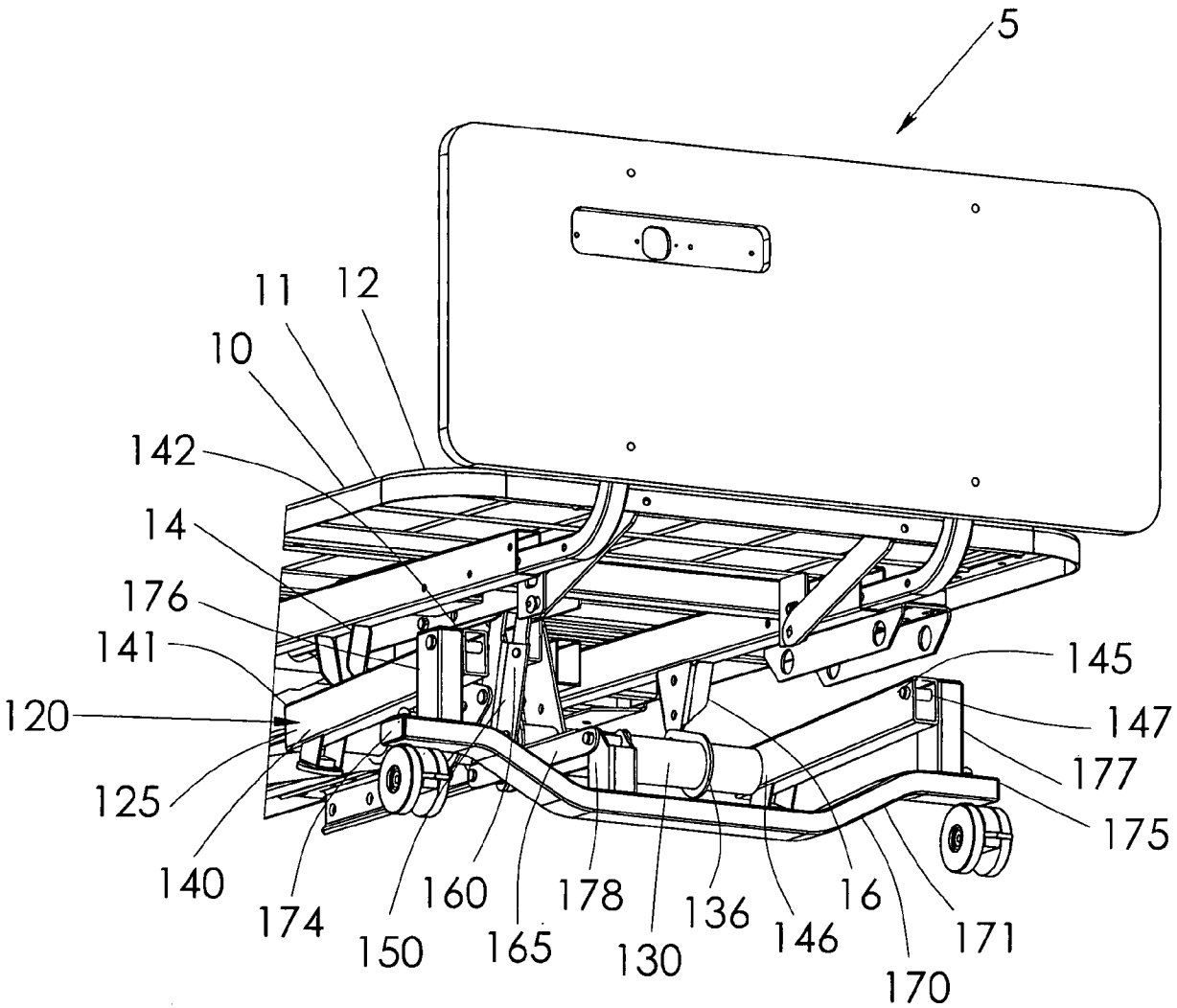
FIG. 5 is a close-up perspective view of a preferred embodiment shown in an intermediate position.
Figure 6:
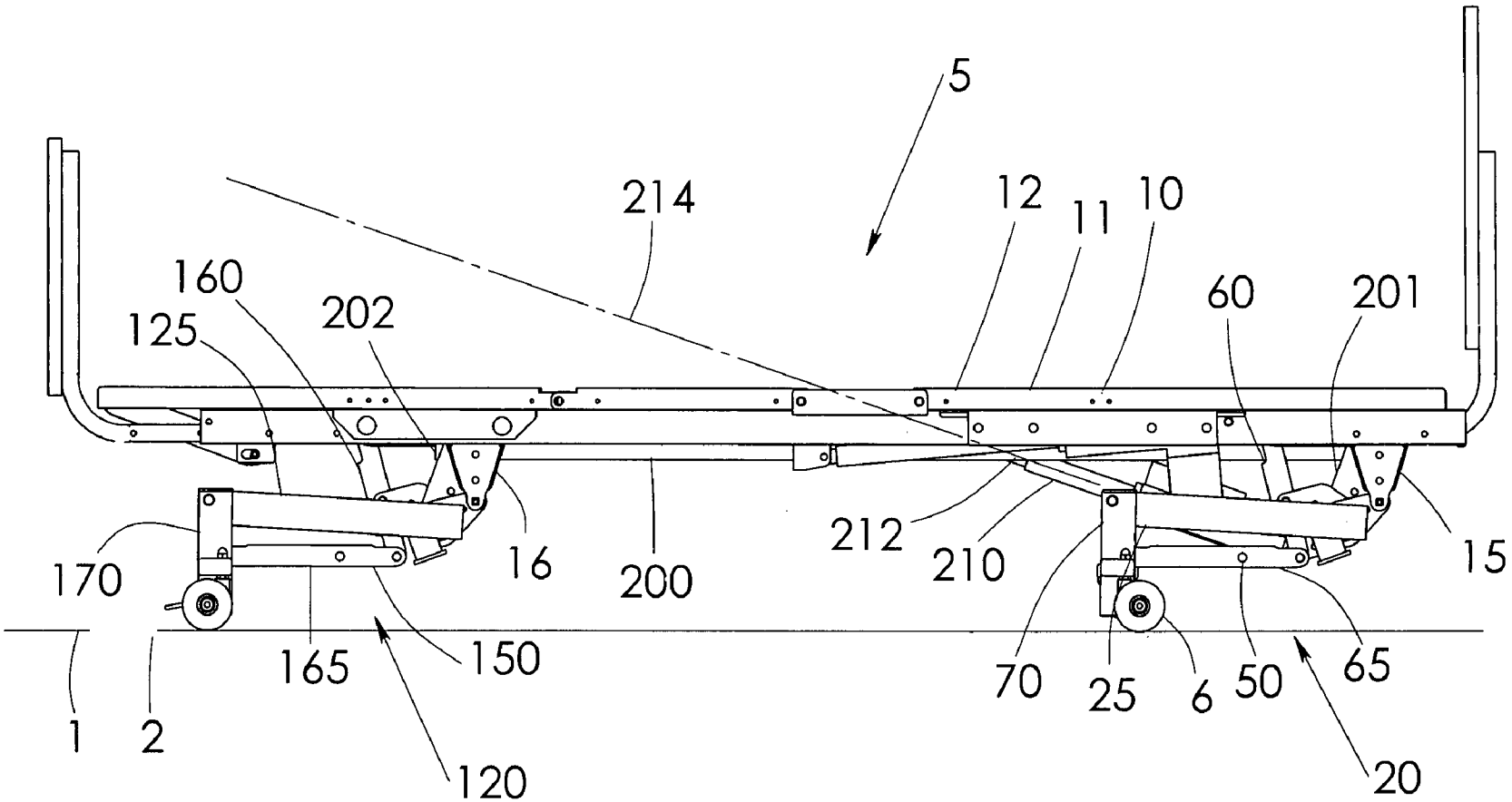
FIG. 6 is a side view of a preferred embodiment shown in an intermediate position.
Figure 7:
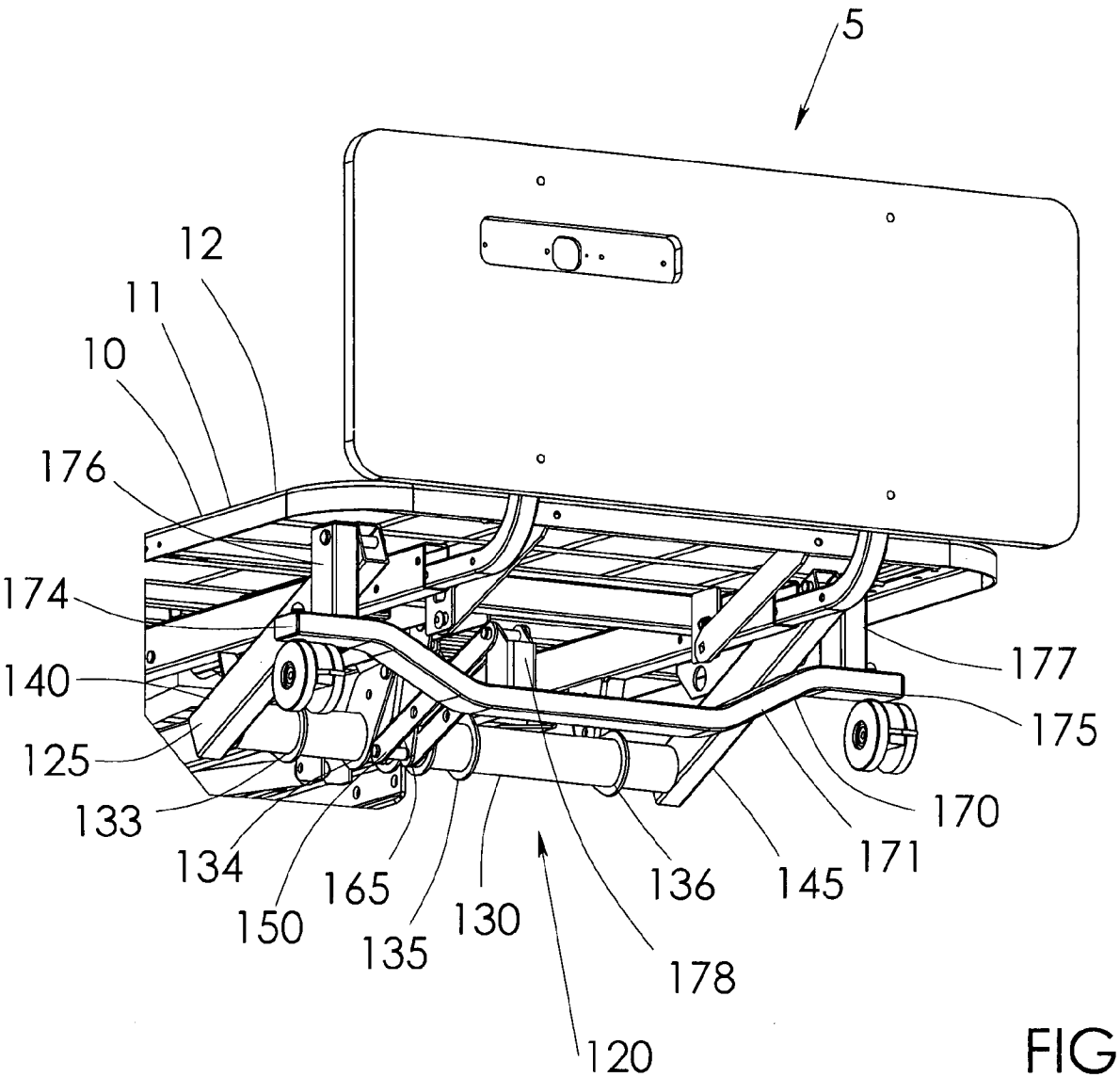
FIG. 7 is a close-up perspective view of a preferred embodiment shown in a lowered position.
Figure 8:
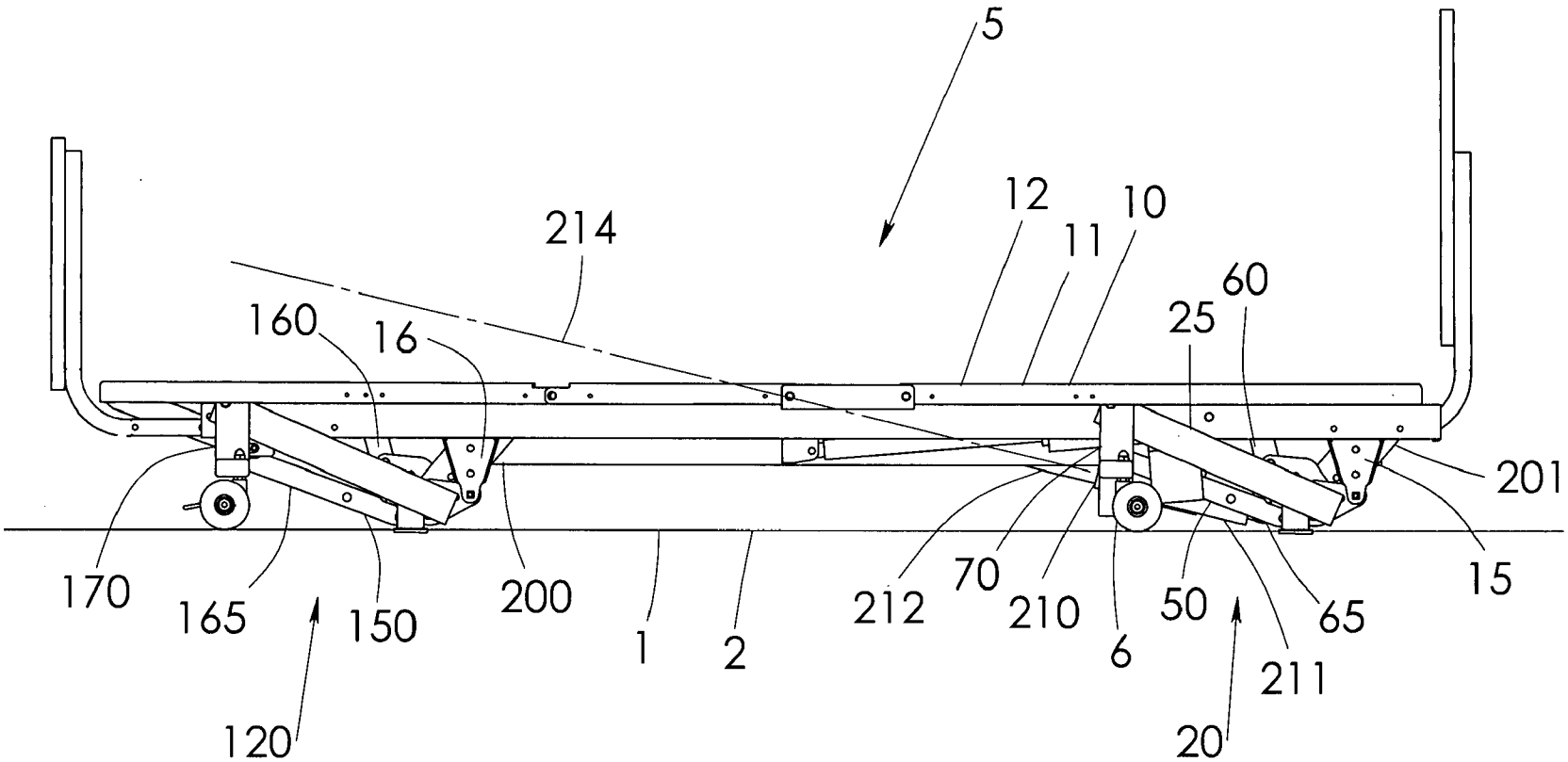
FIG. 8 is a side view of a preferred embodiment shown in a lowered position.
Figure 9:
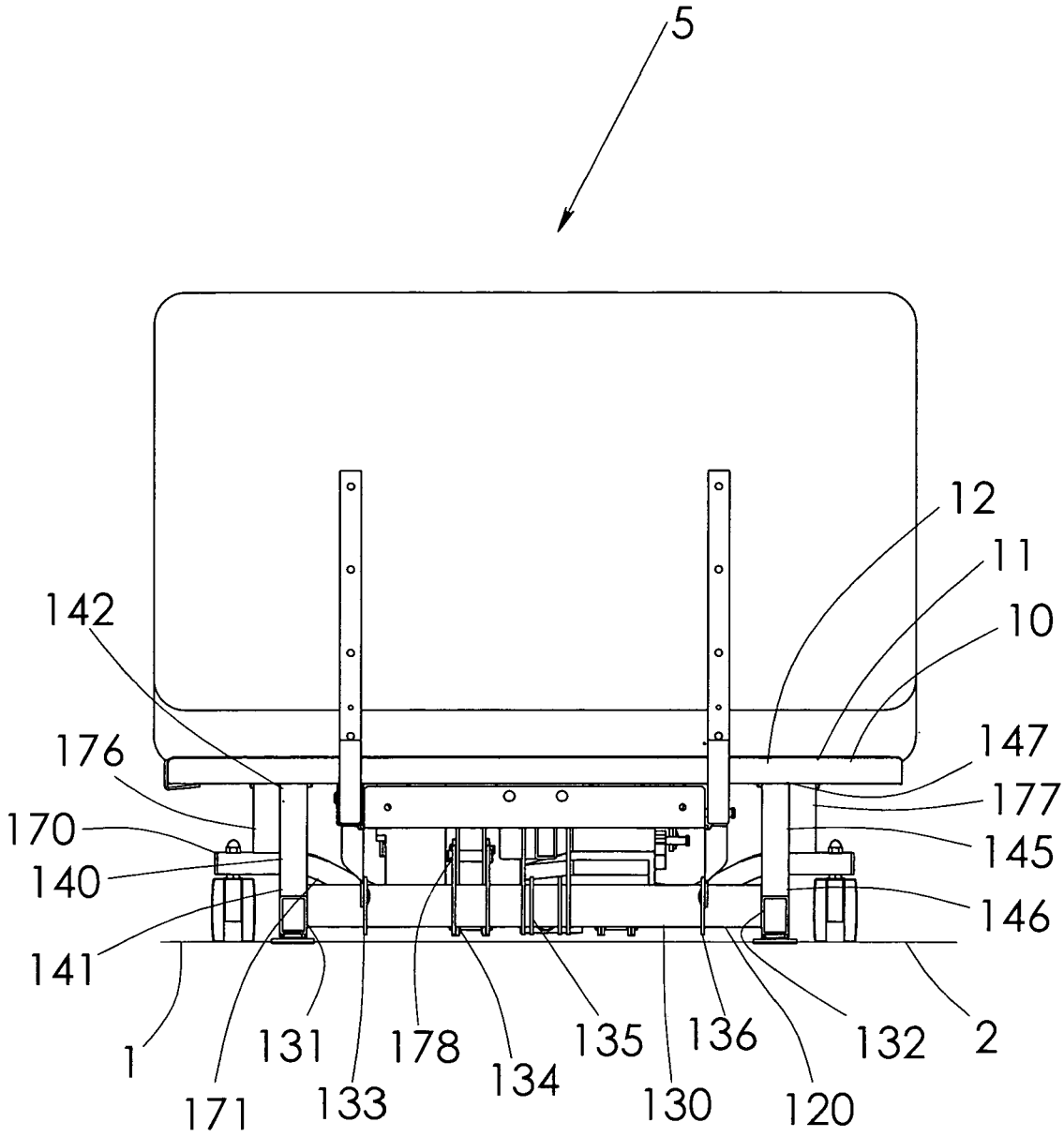
FIG. 9 is an end view of a preferred embodiment shown in a lowered position.

A raised, or high, position of the frame 10 is shown in FIGS. 3 and 4, and is represented by line segments in FIG. 10. An intermediate position of the frame 10 is shown in FIGS. 5 and 6, and is represented by line segments in FIG. 11. A low position of the frame is shown in FIGS. 7-9, and is represented by line segments in FIG. 12

A second articulating structure 120 is provided. The second articulating structure 120 is preferably comprised of a rigid support 125, a serpentine support 150 and a caster support 170. The components are generally and preferably shown to be hollow components having varying shapes and sizes. However, other structures, such as solid members could alternatively be used without departing from the broad aspects of the present invention.

The rigid support 125 of the second articulating structure 120 preferably comprises a tube 130. The tube 130 has a longitudinal axis that preferably lies generally parallel to the top surface plane 12. The tube 130 has a first end 131 and an opposed second end 132. Four brackets 133, 134, 135 and 136, respectively, are preferably welded or otherwise rigidly connected to the tube 130. Bracket 133 is preferably pivotally connected to bracket 14 of the frame 10. Bracket 136 is preferably pivotally connected to bracket 16 of the frame 10.

A first arm 140 is provided and has a first end 141 and a second end 142. The first end 141 is preferably rigidly connected to the first end 131 of tube 130. A second arm 145 is also provided, and has a first end 146 and a second end 147. The first arm 140 and second arm 145 are preferably connected to the tube 130 at a right angles, and as such, are parallel to each other. The tube 130, first arm 145 and second arm 150 preferably form a generally U shaped structure.

It is understood that the second rigid support 125 has many ends, including the pivot points at the second ends 142 and 147 of respective arms 140 and 145, as well as the pivot points at the ends of the brackets 133, 134, 135 and 135 rigidly connected to the tube 130.

The second articulating structure 120 also preferably comprises a serpentine support 150. In a preferred embodiment, the serpentine structure 150 comprises three members, or pieces. The first piece 155 has a first end 156 and a second end 157. The second piece 160 has a first end 161 and a second end 162. The third piece 165 has a first end 166 and a second end 167. The first end 156 of the first piece 155 is preferably pivotally connected to the frame 10. The second end 157 of the first piece 155 is preferably pivotally connected to the first end 161 of the second piece 160. The second piece 160, at a location intermediate the first end 161 and the second end 162, is preferably pivotally connected to bracket 134 on the tube 130. The second end 162 of the second piece 160 is preferably pivotally connected to the first end 166 of the third piece 165.

Further, the second articulating structure 120 also preferably comprises a caster support 170. The caster support 170 preferably comprises a base 171 having a front 172, a rear 173, a first end 174 and a second end 175. The base 171 can be a bent base, such that it dips between the ends 174 and 175, as shown in FIGS. 1 and 2. A first upright 176 is at the first end 174 of the base 171. A second upright 177 is at the second end 175 of the base 171. A third upright 178 can be connected to the base 171 intermediate the first and second ends 174 and 175. The second end 142 of the first arm 140 is preferably pivotally connected to the first upright 176. The second end 147 of the second arm 145 is preferably pivotally connected to the second upright 177. The second end 167 of the third piece 165 of the serpentine support 150 is preferably pivotally connected to the third upright 178.

Starting at a low position, the first articulating support 120 rises as the second end of the second rigid support 125, or the second ends 142 and 147 of the arms 140 and 145, respectively rotate away from the frame 10. The pivot point for this rotation is at the pivoting connections between the brackets 14 and 16 of the frame 10 and 133 and 136 of the tube 130, respectively. Rotation of the tube 130 caused by the pivoting of the second rigid support 125 causes the serpentine support 150 to straighten, and accordingly elongate. Elongation of the serpentine support 150 and rotation of the rigid support 125 cause the frame 10 to rise relative to the castor support 170.

Looking now to FIGS. 10-12, it is shown that in profile, the first articulating structure 20 resembles a split parallelogram. The split parallelogram of the second articulating structure 120 is highly similar or identical to the geometry of the first articulating structure 20, described above. Point A' represents the pivot point between the second end 142 of the first arm 140 and the upright 176. Point B' represents the pivot point between the bracket 113 of the frame 10 and bracket 133 of the tube 130. Point C' represents the longitudinal axis of the tube 130. Point D' represents the pivot point between the first end 166 of the second piece 165 of the serpentine support 150 and the second end 157 of the second piece 155 of the serpentine support 150. Point E' represents the pivot point between the second end 167 of the third piece 165 of the serpentine support 150 and the third upright 178 of the base. Point F' represents pivot point between the first end 161 of the second piece 160 of the serpentine support 150 and the second end 157 of the first piece 155 of the serpentine support 150. Point G' represents the pivot point between the first end 156 of the first piece 155 of the serpentine support 150 at the connection to the frame 10.

Line segments between points are rigid members, although not necessarily along central axis of the respective members. In this regard, line segment A'B' corresponds to the rigid support 125, line segment A'E' corresponds to the caster support 170, line segment D'E' corresponds to the third piece 165 of the serpentine support 150, line segment D'F' corresponds to the second piece 160 of the serpentine support 150, line segment F'G' corresponds to the first piece 155 of the serpentine support 150, and line segment G'B' corresponds to the frame 10.

In this regard, the split or double parallelogram structure of the second articulating structure 120 allows the caster support 170, and hence the casters 6, to be in a selected orientation relative to the frame 10 no matter whether the frame 10 is in a high position, a low position, or at any position there between. A preferred orientation of the casters 6 is normal to the floor plane 2. However, it will be understood that other orientations of the casters 6 may be used without departing from the broad aspects of the present invention.

A raised, or high, position of the frame 10 is shown in FIGS. 3 and 4, and is represented by line segments in FIG. 10. An intermediate position of the frame 10 is shown in FIGS. 5 and 6, and is represented by line segments in FIG. 11. A low position of the frame is shown in FIGS. 7-9, and is represented by line segments in FIG. 12

Optionally, a rigid base structure (not shown) could be alternatively used instead of the serpentine structures to achieve the desired orientation of the caster supports 70 and 170.

According to another preferred aspect of the present invention, a drag link 200 is provided. The drag link 200 has a first end 201 and a second end 202. The drag link first end 201 is preferably pivotally connected to bracket 34 of the tube 30. The drag link second end 202 is preferably pivotally connected to bracket 135 of tube 130. The drag link 200 ensures that the first articulating structure 20 and the second articulating structure act cooperatively at the same rate to achieve the same amount of lift of the frame 10.

According to yet another preferred aspect of the present invention, a linear drive assembly 210 is provided. The linear drive assembly 210 has a motor 211 and an actuator 212 that can selectably extend from the housing containing the motor 211. The actuator has a distal end 213 and defines a longitudinal axis 214.

According to a preferred embodiment, the housing can be rotatably connected to the rigid support 25 of the first articulating structure 20. More particularly, the motor 212 and housing are preferably connected to the tube 30 of the first articulating structure 20. The distal end 213 of the actuator 212 of the linear drive assembly 210 is preferably pivotally connected to the drag link 200 at a location intermediate the drag link first end 201 and the drag link second end 202, as shown in FIGS. 1 and 2. As illustrated in FIGS. 4, 6, and 8, the angle between the longitudinal axis 214 of the actuator 212 and the plane 12 of the frame never approaches zero no matter the position of the frame 10. The minimum preferred angle of the longitudinal axis 214 is approximately between 10 and 20 degrees. In this regard, even at the low bed position, there is still a vertical lift resultant force component of the overall actuator force.

Returning attention to FIGS. 10-12, it is shown that the location of the motor 211 of the linear drive assembly 210 is at a point that is a fixed distance from points B and C. In this regard, it is understood that the linear drive assembly is rotatably connected to the rigid frame 25 of the first articulating structure 20.

During operation of the linear drive assembly 210, the linear drive assembly operates, or moves in two directions. In this regard, the distal end 213 of the actuator 212 operates against the drag link 200 to move the drag link towards the second articulating structure 120. Simultaneously, the housing and motor 211 move to force the second end of the first rigid structure 25 to rotate away from the frame 10. Rotation of the second end of the first rigid structure 25 away from the frame 10 causes the frame to lift relative to the caster support 70. Also, rotation of the first rigid structure 25 includes rotation of the tube 30 and bracket 34. Bracket 34, being pivotally connect to the drag link first end 201, redirects the rotational force within the first rigid member 25 to move the drag link 200 towards the second articulation structure 120.

Moving the drag link towards the second articulating structure 120 causes the rigid support 125 of the second articulating structure 120 to pivot, such that the second end of the rigid support 125 of the second articulating structure 120 rotates away from the frame 10 at the same rate as the second end of the rigid support 25 of the first articulating structure 20.

The geometry of the structure of the articulating structures 20 and 120 described above, and particularly the location of the pivots between the articulating structures 20 and 120, and the frame 10, respectively, results in minimal swing of the frame 10 as it is raised from the low position to the high position. From the low position, it is preferably that the frame 10 moves laterally approximately less than 5 inches relative to the casters 6.

In the preferred embodiment, a total stroke length of approximately between 7 and 15 inches in the linear drive assembly 210 produces a lift in the frame 10 of at least 10 inches. At any given point along the stroke length of the actuator 212, there is a preferred maximum ratio of stroke length to frame lift of 1:2. That is, for each 1 inch of stroke, the frame lifts a maximum of 2 inches. The minimum preferred angle of the longitudinal axis 214 of the actuator 212 relative to the frame plane 12 is approximately between 10 and 20 degrees.

Thus it is apparent that there has been provided, in accordance with the invention, a supported frame with articulating structures that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A supported frame that is operable at and between a high and low position, said supported frame comprising:

a frame;

a first articulating structure having;

a first caster support;

a first rigid support having a first rigid support first end and a first rigid support second end, said first rigid support first end being rotatably connected to said frame and said first rigid support second end being rotatably connected to said first caster support; and a first serpentine support having a first serpentine support first end and a first serpentine support second end, said first serpentine support first end being rotatably connected to said frame and said first serpentine support second end being rotatably connected to said first caster support; and a second articulating structure having;

a second caster support;

a second rigid support having a second rigid support first end and a second rigid support second end, said second rigid support first end being rotatably connected to said frame and said second rigid support second end being rotatably connected to said second caster support; and a second serpentine support having a second serpentine support first end and a second serpentine support second end, said second serpentine support first end being rotatably connected to said frame and said second serpentine support second end being rotatably connected to said second caster support, wherein as said first rigid support second end rotates away from said frame, said first serpentine support second end extends away from said first serpentine support first end, and said first rigid support second end and said first serpentine support second end cooperate to maintain a selected orientation of said first caster support at both the high position and the low position of the supported frame, and wherein as said second rigid support second end rotates away from said frame, said second serpentine support second end extends away from said second serpentine support first end, and said second rigid support second end and said second serpentine support second end cooperate to maintain a selected orientation of said second caster support at both the high position and the low position of the supported frame.

2. The supported frame of claim 1 further comprising a drag link having a drag link first end and a drag link second end, said drag link first end being connected to said first articulating structure and said drag link second end being connected to said second articulating structure, wherein said first articulating structure and said second articulating structure act in cooperation.

3. The supported frame of claim 2 wherein:

said first rigid support further comprises a first rigid support third end, said first rigid support third end being pivotally connected to said drag link first end, and said second rigid support further comprises a second rigid support third end, said second rigid support third end being pivotally connected to said drag link second end.

4. The supported frame of claim 3 further comprising a linear drive assembly connected to said first rigid support between said first rigid support first end and said first rigid support second end, said linear drive assembly causing said first rigid support second end to pivot away from said frame.

5. The supported frame of claim 4 wherein:

said linear drive assembly comprises a motor and an actuator having a distal end;

said motor is directly connected to said first rigid support;

said distal end of said actuator is directly connected to said drag link between said drag link first end and said drag link second end; and expansion of said linear drive assembly causes the motor to move in a first direction and the distal end of the actuator to expand in a second direction, wherein movement in the second direction by said distal end of said actuator causes the drag link to move towards said second articulating structure, and movement in the first direction by said motor causes said first rigid support to rotate about said first rigid support second end, thereby causing redirection of said first rigid support third end about said first rigid support second end to force said drag link towards said second articulating structure.

6. A supported frame that is operable between a high position and a low position, said supported frame comprising:

a frame;

a first articulating structure comprising:

a first caster support, said first caster support supporting at least one caster; and a first rigid support having a first rigid support first end and a first rigid support second end, said first rigid support first end being pivotally connected to said frame and said first rigid support second end being pivotally connected to said first caster support;

a second articulating structure comprising:

a second caster support, said second caster support supporting at least one caster; and a second rigid support having a second rigid support first end and a second rigid support second end, said second rigid support first end being pivotally connected to said frame and said second rigid support second end being pivotally connected to said second caster support;

a drag link having a drag link first end and a drag link second end, said drag link first end being pivotally connected to said first articulating structure and said drag link second end being pivotally connected to said second articulating structure enabling said first articulating structure and said second articulating structure to act in cooperation; and a linear drive assembly pivotally connected directly to said first rigid support and pivotally connected directly to said drag link, wherein as said linear drive expands, said first rigid support second end rotates away from said frame to increase the distance between said first caster support and said frame, and simultaneously said second rigid support second end rotates away from said frame to increase the distance between said second caster support and said frame.

7. The supported frame of claim 6 wherein:

said first rigid support further comprises a first rigid support third end, said first rigid support third end being pivotally connected to said drag link first end, and said second rigid support further comprises a second rigid support third end, said second rigid support third end being pivotally connected to said drag link second end.

8. The supported frame of claim 7 wherein:

said first articulating structure further comprises a first serpentine support having a first serpentine support first end and a first serpentine support second end, said first serpentine support first end being rotatably connected to said frame and said first serpentine support second end being rotatably connected to said first caster support; and said second articulating structure further comprises a second serpentine support having a second serpentine support first end and a second serpentine support second end, said second serpentine support first end being rotatably connected to said frame and said second serpentine support second end being rotatably connected to said second caster support, wherein as said first rigid support second end rotates away from said frame, said first serpentine support second end extends away from said second serpentine support first end, and said first rigid support second end and said first serpentine support second end cooperate to maintain a selected orientation of said first caster support at both the high position and the low position of the supported frame, and wherein as said second rigid support second end rotates away from said frame, said second serpentine support second end extends away from said second serpentine support first end, and said second rigid support second end and said second serpentine support second end cooperate to maintain a selected orientation of said second caster support at both the high position and the low position of the supported frame.

9. The supported frame of claim 8 wherein said selected orientation of said first caster support and said second caster support is normal to the floor.

10. The supported frame of claim 8 wherein:

said linear drive assembly comprises a motor and an actuator having a distal end;

said motor is connected directly to said first rigid member;

said distal end of said actuator is connected directly to said drag link between said first drag link end and said second drag link end; and expansion of said linear drive assembly causes the motor to move in a first direction and the distal end of the actuator to expand in a second direction, wherein movement in the second direction by said distal end of said actuator causes the drag link to move towards said second articulating structure, and movement in the first direction by said motor causes said rigid support to rotate about said first rigid support second end, thereby causing redirection of said first rigid support third end about said first rigid support second end to force said drag link towards said second articulating structure.

11. A supported frame that is operable between a high position and a low position, said supported frame comprising:

a frame with a top surface lying in a frame plane;

a first pair of casters and a second pair of casters;

a first structure being a first articulating structure comprising:

a first caster support, said first caster support supporting at least one caster; and a first rigid support having a first rigid support first end, a first rigid support second end and a first rigid support third end, said first rigid support first end being pivotally connected to said frame and said first rigid support second end being connected to said first caster support, wherein said first articulating structure is connected to said frame and to said first pair of casters, said first structure able to selectably raise and lower said frame relative to said first pair of casters;

a second structure being a second articulating structure comprising:

a second caster support, said second caster support supporting at least one caster; and a second rigid support having a second rigid support first end, a second rigid support second end and a second rigid support third end, said second rigid support first end being pivotally connected to said frame and said second rigid support second end being connected to said second caster support, wherein said second articulating structure is connected to said frame and to said second pair of casters, said second structure able to selectably raise and lower said frame relative to said second pair of casters; and at least one linear drive assembly connected to one of said first structure and said second structure, said at least one linear drive assembly comprising an actuator having a longitudinal axis, a drag link having a drag link first end and a drag link second end, said drag link first end being pivotally connected to said first rigid support third end and said drag link second end being pivotally connected to said second rigid support third end enabling said first articulating structure and said second articulating structure to act in cooperation; and said at least one linear drive assembly has a linear drive assembly first end and a linear drive assembly second end, said linear drive assembly first end being pivotally connected to said first rigid support and said linear drive assembly second end being pivotally connected to said drag link wherein said linear drive assembly causes a maximum of 2 inches of lift of said frame for each 1 inch of stroke of said linear drive assembly, wherein said linear drive assembly expands in two directions relative to said frame during the raising of said frame from a low position, wherein movement in the first direction is by said linear drive assembly second end, which forces said drag link towards said second articulating structure, and wherein movement in the second direction is by said linear drive assembly first end, which forces said first rigid support second end to rotate away from said frame about said first rigid support second end, thereby causing redirection of said first rigid support third end to force said drag link towards said second articulating structure.

12. The supported frame of claim 11 wherein said lift in said frame is at least 10 inches and said actuator longitudinal axis is at an angle relative to said frame plane that is at least 10 degrees when said support frame is positioned at a low position wherein said frame is proximal said ground.

13. The supported frame of claim 11 wherein:

said first articulating structure further comprises a first serpentine support having a first serpentine support first end and a first serpentine support second end, said first serpentine support first end being rotatably connected to said frame and said first serpentine support second end being rotatably connected to said first caster support; and said second articulating structure further comprises a second serpentine support having a second serpentine support first end and a second serpentine support second end, said second serpentine support first end being rotatably connected to said frame and said second serpentine support second end being rotatably connected to said second caster support, wherein as said first rigid support second end rotates away from said frame, said first serpentine support second end extends away from said second serpentine support first end, and said first rigid support second end and said first serpentine support second end cooperate to maintain a selected orientation of said first caster support at both the high position and the low position of the supported frame, and wherein as said second rigid support second end rotates away from said frame, said second serpentine support second end extends away from said second serpentine support first end, and said second rigid support second end and said second serpentine support second end cooperate to maintain a selected orientation of said second caster support at both the high position and the low position of the supported frame.

14. A supported frame that is operable between a high position and a low position, said supported frame comprising:

a frame;

a first articulating structure comprising:

a first caster support, said first caster support supporting at least one caster; and a first rigid support having a first rigid support first end, a first rigid support second end and a first rigid support third end, said first rigid support first end being pivotally connected to said frame and said first rigid support second end being connected to said first caster support;

a second articulating structure comprising:

a second caster support, said second caster support supporting at least one caster; and a second rigid support having a second rigid support first end, a second rigid support second end and a second rigid support third end, said second rigid support first end being pivotally connected to said frame and said second rigid support second end being connected to said second caster support;

a drag link having a drag link first end and a drag link second end, said drag link first end being pivotally connected to said first rigid support third end and said drag link second end being pivotally connected to said second rigid support third end enabling said first articulating structure and said second articulating structure to act in cooperation; and a linear drive assembly having a linear drive assembly first end and a linear drive assembly second end, said linear drive assembly first end being pivotally connected to said first rigid support and said linear drive assembly second end being pivotally connected to said drag link, wherein said linear drive assembly expands in two directions relative to said frame during the raising of said frame from a low position, wherein movement in the first direction is by said linear drive assembly second end, which forces said drag link towards said second articulating structure, and wherein movement in the second direction is by said linear drive assembly first end, which forces said first rigid support second end to rotate away from said frame about said first rigid support second end, thereby causing redirection of said first rigid support third end to force said drag link towards said second articulating structure.

15. The supported frame of claim 14 wherein:

said first articulating structure further comprises a first serpentine support having a first serpentine support first end and a first serpentine support second end, said first serpentine support first end being rotatably connected to said frame and said first serpentine support second end being rotatably connected to said first caster support; and said second articulating structure further comprises a second serpentine support having a second serpentine support first end and a second serpentine support second end, said second serpentine support first end being rotatably connected to said frame and said second serpentine support second end being rotatably connected to said second caster support, wherein as said first rigid support second end rotates away from said frame, said first serpentine support second end extends away from said second serpentine support first end, and said first rigid support second end and said first serpentine support second end cooperate to maintain a selected orientation of said first caster support at both the high position and the low position of the supported frame, and wherein as said second rigid support second end rotates away from said frame, said second serpentine support second end extends away from said second serpentine support first end, and said second rigid support second end and said second serpentine support second end cooperate to maintain a selected orientation of said second caster support at both the high position and the low position of the supported frame.

16. The supported frame of claim 15 wherein said selected orientation of said first caster support and said second caster support is normal to the floor.

17. The supported frame of claim 14 wherein:

said frame lies in a plane; and said linear drive assembly comprises a motor and an actuator having a distal end and having a longitudinal axis, said motor being connected to said first rigid support and said distal end being connected to said drag link intermediate said drag link first end and said drag link second end, wherein the angle of said longitudinal axis relative to said plane of said frame is substantially greater than zero degrees for the entire stroke of said linear drive assembly.

18. The supported frame of claim 17 wherein an entire stroke of said linear drive assembly causes a lift of at least 16 inches of said frame relative to said first caster support and said second caster support.

* * * * *